US008079813B2

(12) United States Patent
Liang

(10) Patent No.: US 8,079,813 B2
(45) Date of Patent: Dec. 20, 2011

(54) TURBINE BLADE WITH MULTIPLE TRAILING EDGE COOLING SLOTS

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 532 days.

(21) Appl. No.: 12/355,912

(22) Filed: Jan. 19, 2009

(65) Prior Publication Data

US 2010/0183429 A1 Jul. 22, 2010

(51) Int. Cl.
*F01D 5/18* (2006.01)
*F01D 5/08* (2006.01)
*F01D 5/20* (2006.01)

(52) U.S. Cl. ..... 416/97 R; 416/96 R

(58) Field of Classification Search ..... None
See application file for complete search history.

(56) References Cited

U.S. PATENT DOCUMENTS

| | | | | |
|---|---|---|---|---|
| 4,073,599 | A | 2/1978 | Allen et al. | |
| 4,526,512 | A | 7/1985 | Hook | |
| 4,930,980 | A | 6/1990 | North et al. | |
| 5,176,499 | A | 1/1993 | Damlis et al. | |
| 5,813,827 | A | 9/1998 | Nordlund et al. | |
| 5,927,946 | A | 7/1999 | Lee | |
| 6,102,658 | A * | 8/2000 | Kvasnak et al. | 416/97 R |
| 6,331,098 | B1 | 12/2001 | Lee | |
| 6,471,479 | B2 | 10/2002 | Starkweather | |
| 6,499,949 | B2 | 12/2002 | Schafrik et al. | |
| 6,506,013 | B1 | 1/2003 | Burdgick et al. | |
| 6,517,312 | B1 | 2/2003 | Burns et al. | |
| 6,589,010 | B2 | 7/2003 | Itzel et al. | |
| 6,607,356 | B2 | 8/2003 | Manning et al. | |
| 6,761,534 | B1 | 7/2004 | Willett | |
| 6,957,949 | B2 | 10/2005 | Hyde et al. | |
| 6,981,840 | B2 | 1/2006 | Lee | |
| 6,984,103 | B2 | 1/2006 | Lee et al. | |
| 7,125,225 | B2 | 10/2006 | Surace et al. | |
| 7,255,535 | B2 | 8/2007 | Albrecht et al. | |
| 7,980,821 | B1 * | 7/2011 | Liang | 416/97 R |
| 2005/0111979 | A1 * | 5/2005 | Liang | 416/97 R |
| 2005/0281675 | A1 * | 12/2005 | Liang | 416/97 R |
| 2007/0128028 | A1 * | 6/2007 | Liang | 416/97 R |
| 2007/0128029 | A1 * | 6/2007 | Liang | 416/97 R |

FOREIGN PATENT DOCUMENTS

JP 04203203 A 7/1992

* cited by examiner

*Primary Examiner* — Ha Tran T Nguyen
*Assistant Examiner* — Shantanu C Pathak

(57) ABSTRACT

A cooling system for a turbine airfoil of a turbine engine has a multiple suction side cooling slots extending from a front edge on the suction side to the center of the trailing edge or even to the pressure side of the center line and a pressure side cooling slot curving to a pressure side outlet forward of the trailing edge and having a front pressure side lip that is aligned with or forward of the front edge of the suction side cooling slots. The suction side cooling slots receive cooling flow from the pressure side cooling slots through a boundary layer bleed valve, which is also aligned with or rearward of the pressure side lip. The cooling system may also combine double impingement cooling with these features. The cooling system minimizes shear mixing, reduces hot spots and can reduce the trailing edge thickness, resulting in more efficient stage performance and extended operational life.

14 Claims, 2 Drawing Sheets

TURBINE BLADE WITH MULTIPLE TRAILING EDGE COOLING SLOTS

FIELD OF THE INVENTION

This invention is directed generally to turbine airfoils, and more particularly to cooling systems in hollow turbine airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures, particularly in concentrated areas of over temperature, sometimes referred to as hot spots.

Typically, turbine blades are formed from a root portion having a platform at one end and an elongated portion forming a blade that extends outwardly from the platform coupled to the root portion. The blade is ordinarily composed of a tip opposite the root section, a leading edge, and a trailing edge. The inner aspects of most turbine blades typically contain an intricate maze of cooling channels forming a cooling system. The cooling channels in a blade receive air from the compressor of the turbine engine and pass the air through the blade. The cooling channels often include multiple flow paths that are designed to maintain all aspects of the turbine blade at a relatively uniform temperature.

Size and space limitations make trailing edges one of the more challenging sections of a turbine blade to cool. Traditionally, a trailing edge camber line discharge together with pin fins or multiple impingements has been used airfoil trailing edge region cooling. Such design requires a thicker trailing edge that can induce higher aerodynamic blockage and reduce stage performance. Techniques for cooling a thinner trailing edge have been developed. For example, a first stage blade can utilize a pressure side bleed the exhausts on the pressure side adjacent to the tip of the trailing edge, rather than a camber line discharge at the center of the trailing edge. This cooling channel arrangement allows for a reduction in the effective thickness of the trailing edge when compared to the required thicknesses of both the suction side and pressure side regions of the trailing edge surrounding a camber line cooling discharge.

However, the pressure side bleed cooling approach causes a side flow and presents shear mixing between the cooling air and the mainstream flow as the cooling air exits the pressure side channel outlet. The shear mixing of the cooling air with the mainstream flow reduces cooling effectiveness of the trailing edge overhang, thus inducing over temperature or a hot spot at the trailing edge suction side location. Frequently, a hot spot can become the life limiting location for the entire airfoil. Thus, a need exists for a cooling system capable of providing sufficient cooling to a relatively thinner trailing edge of a turbine airfoil.

SUMMARY OF THE INVENTION

The invention relates to a turbine airfoil cooling system for a turbine airfoil used in turbine engines. In particular, a turbine airfoil cooling system can include a trailing edge cooling structure in which multiple submerged suction side cooling slots are spaced span wise along the blade and extend chord wise to provide an opening beginning at a front edge on the suction side and extending to a terminal location at the trailing edge. The terminal location can be around the curve or corner of the suction side region, at the center line of the trailing edge or even extend around the corner of the trailing edge into the pressure side region of the trailing edge. The cooling system further includes at least one trailing edge cooling channel positioned within the airfoil and extending toward the trailing edge, but terminating in a pressure side cooling slot that exhausts onto the pressure side upstream of the trailing edge. The pressure side cooling slot has a forward pressure side lip at its junction with the pressure side. The front edge of the suction side cooling slots is no further forward chord wise than the pressure side lip, i.e. the front edge is aligned with or rearward of the pressure side lip. The pressure side cooling slot can have a curving rearward side that curves to a pressure side outlet forward of the trailing edge. At least one boundary layer bleed hole connects the pressure side cooling slot to at least one of the suction side cooling slots. This bleed hole is rearward or downstream of the pressure side lip.

Each suction side cooling slot can have a depth profile with a variable depth into the outer wall of the airfoil on the suction side, and this slot depth can become deeper as the slot extends towards the trailing edge. The variable depth of each suction side cooling slot can transition from the suction side surface to a maximum depth at its opening at the trailing edge. The variable depth of each suction side cooling slot can curve towards the trailing edge. The depth of one of the suction side cooling slots can vary differently from the depth of another suction side cooling slot or they can be the same.

The interconnecting boundary layer bleed hole preferably extends from the curved rearward side of the pressure side cooling slot to at least one of the suction side cooling slots. The boundary layer bleed hole can be oriented relative to the convex suction side of the airfoil so that cooling flow in the suction side cooling slot is concurrent with the mainstream flow along the suction side, whereby shear mixing between the mainstream flow and the cooling flow is reduced. The profile shape of each suction side cooling slot can also be oriented relative to the convex suction side so that cooling flow in the suction side cooling slot is concurrent with the mainstream flow along the suction side to reduce this shear mixing.

The cooling system can provide multiple pressure side cooling slots, each paired to a separate one of the suction side cooling slots through a boundary layer bleed hole.

The pressure side cooling slot can be shaped to include a metering section sized to substantially match cooling flow conditions to hot gas flow conditions prior to discharge from the pressure side cooling slot. Additionally, the pressure side cooling slot can be shaped to include a diffuser section wherein the cross-sectional area of the pressure side cooling slot increases towards the pressure side outlet. These features can also be combined with a trailing edge cooling channel that provides impingement holes and cavities for double impingement cooling.

An advantage of this invention is that multiple suction side cooling slots reduce the airfoil trailing edge effective thickness, thus reducing base region heat load, resulting in reduced trailing edge metal temperature and improved airfoil life. A reduced trailing edge thickness can also reduce airfoil blockage and minimize stage pressure losses, translating into improved turbine stage performance.

Another advantage is that the suction side submerged cooling slots provide additional convective cooling for the trailing edge corner, thus minimizing hot spots in this region of the airfoil. The relatively increased depth of the submerged cooling slots can lower the cooling air velocity and yield good downstream film effectiveness. This slot design can also minimize shear mixing, thus lowering aerodynamic loss and maintain high film cooling effectiveness for the suction side surface of the airfoil. This design also reduces pressure side cut back, thus minimizing shear mixing and increasing film effectiveness on the pressure side.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF EMBODIMENTS OF THE INVENTION

Figure 1:
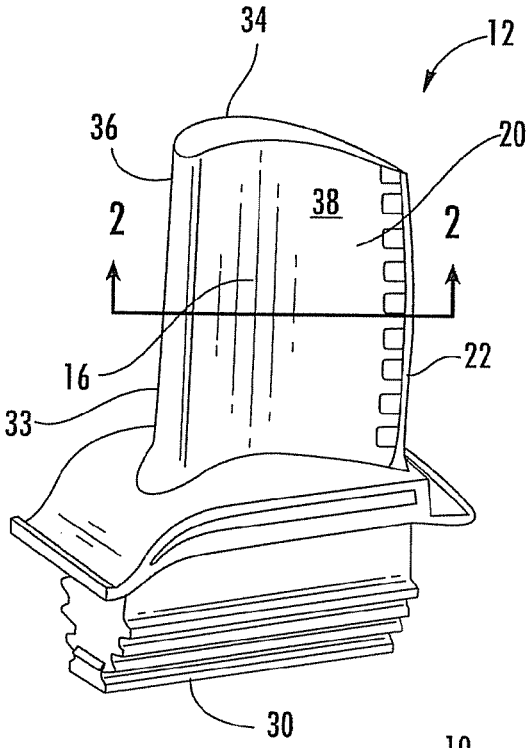
FIG. 1 is a perspective view of an embodiment of a turbine airfoil according to aspects of the invention.
Figure 2:
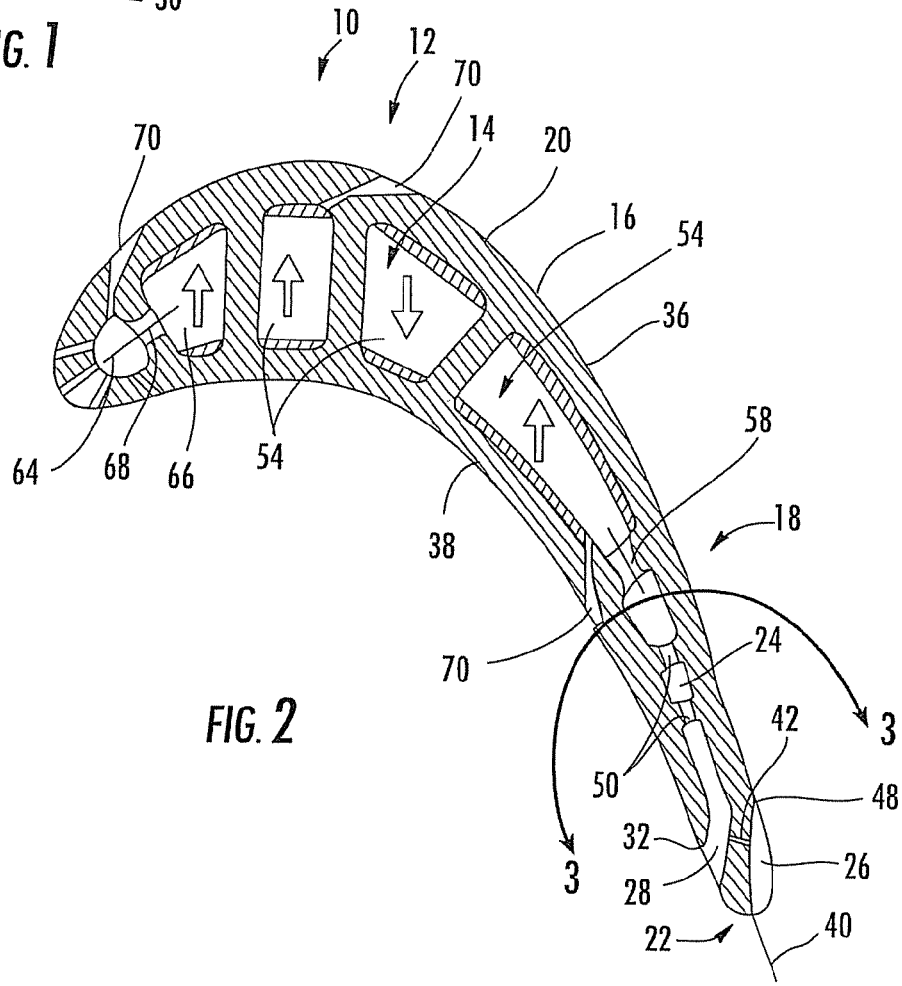
FIG. 2 is a cross-sectional view of the turbine airfoil shown in FIG. 1 taken along line 2-2, showing a trailing edge cooling system according to aspects of the invention.
Figure 3:
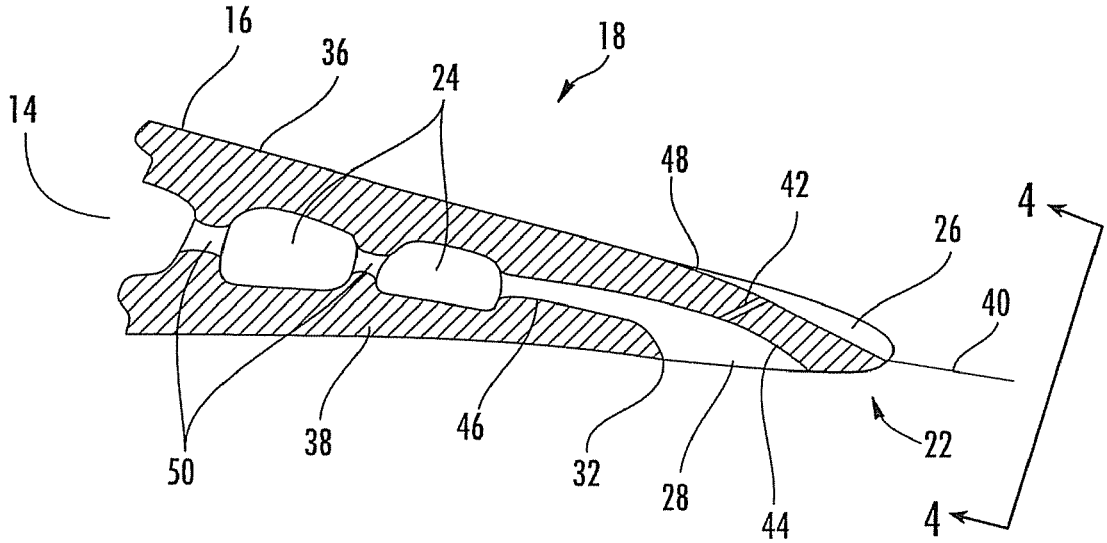
FIG. 3 is a detailed cross-sectional view of the trailing edge cooling system shown in FIG. 2 along line 3-3.

As shown in FIGS. 1-4, the invention is directed to a turbine airfoil cooling system 10 for a turbine airfoil 12 used in turbine engines. In particular, the turbine airfoil cooling system 10 may include one or more internal cavities 14, as shown in FIGS. 2 and 3, positioned between outer walls 16 of a generally elongated, hollow airfoil body 20 of the turbine airfoil 12. The cooling system 10 may include one or more trailing edge cooling channels 18 positioned within the generally elongated, hollow airfoil body 20.

The turbine blade into which the cooling system is integrated can have a general overall construction similar to existing turbine blades, and made from conventional alloys or similar materials. The turbine blade can have application, for example, in a first stage of a turbine engine. As shown in FIG. 1, the airfoil 12 can have a hollow airfoil body 20 generally elongated span wise, and the outer wall 16 can extend chord wise from a forward leading edge 33 to a rearward trailing edge 22. A tip section 34 is located at a first span wise end, and a root 30 is coupled to the airfoil body 20 at an end generally opposite the first end span wise for supporting the airfoil body 20 and for coupling the airfoil body 20 to a disc (not shown). A cooling system is formed from at least one cavity 14 in the elongated, hollow airfoil body 20 positioned in internal aspects of the airfoil body 20. The cavity 14, as shown in FIG. 2, may be positioned in inner aspects of the airfoil body 20 for directing one or more gases, which may include air received from a compressor (not shown), through the airfoil body 20 to reduce the temperature of the airfoil body 20. The cavity 14 may be arranged in various configurations and is not limited to a particular flow path.

The outer wall 16 can have a concave pressure side 38 and a convex suction side 36 separated rearwardly by the trailing edge 22. The trailing edge 22 can be formed by the junction of the concave pressure side 38 and the convex suction side 36 and be considered to have an imaginary central line 40 that can be aligned with the camber line of the airfoil 12. The trailing edge 22 can have a pressure side region on one side of the center line 40 and a suction side region on the other side of the center line 40.

Trailing edge cooling channels such as trailing edge cooling channel 18 may be positioned proximate to the trailing edge 22 and terminate in a pressure side cooling slot 28 curved to exhaust onto the pressure side 38 forward of the trailing edge 22. A pressure side lip 32 is defined at the forward junction of the pressure side cooling slot 28 with the pressure side 38. In at least one embodiment, a series of suction side cooling slots, such as suction side cooling slot 26, are formed on the suction side 36 near and extending to the region of the trailing edge 22 from a front edge 48. The front edge 48 of the suction side cooling slot is no further forward chord wise than the pressure side lip 32, and is preferably aligned chord wise, but can be positioned rearward. Cooling air flow is supplied to the suction side cooling slot 26 from the pressure side cooling slot 28 through a boundary layer bleed hole 42, which is downstream of the pressure side lip 32. The suction side cooling slot 26 can be recessed or submerged in the suction side 36 of the outer wall 16 near the trailing edge 22 and the depth of the suction side cooling slot recess 26 can extend into the thickness of the outer wall 16 "around the corner," e.g. past the center line 40 into the pressure side region of the trailing edge 22.

The trailing edge cooling channel 18 can be provided with an impingement cooling system, such as the double impingement cooling system as shown. A series of impingement holes 50 and impingement cavities 24 can be provided along the cooling flow path from the first up-pass 14 of a serpentine cooling flow circuit towards the trailing edge 22. The double impingement cools the upper portion of the airfoil trailing edge in conjunction with the multiple bleed slots at the trailing edge exit.

FIG. 3 shows a detailed view of an embodiment of a trailing edge multiple slot configuration. Cooling air for the trailing edge section can be metered in a metering section 46 at the entrance section of the pressure side bleed slots 28 to closely match the hot gas flow conditions prior to discharge from the pressure side slots 28. A portion of the cooling air is bled off from the pressure side cooling slots 28 though the curved rear surface 44 into the suction side recessed slots 26. As the cooling flow enters the suction side cooling slots 26 at the mainstream interface location, the spacing provided by the suction side cooling slots 26 can allow the cooling air to form a concurrent flow with the mainstream flow and reduce shear mixing as the flow exhausts. The volume of the suction side cooling slots 26 can also reduce the velocity of the cooling flow, prolonging its presence in the trailing edge region and enhancing the cooling effectiveness for the airfoil trailing edge 22.

According to an aspect of the invention, the suction side cooling slots 26 can be sized and positioned so that the openings of the slots 26 extend to the trailing edge region. The suction side cooling slots 26 can terminate on the suction side near at the center line 40 of the trailing edge 22 but through the curve or corner of the suction side region of the trailing edge. Alternatively, the suction side cooling slot opening 26 can terminate rearwardly at the center line 40 of the trailing edge 22. Even further, the suction side cooling slot opening 26 can extend past the center line 40 of the trailing edge 22 and terminate in the pressure side region of the trailing edge 22 as shown in FIGS. 2 and 3.

The depth of the suction side cooling slots 26 can be varied along the chord wise length of each slot. For example, the depth profile can begin at the outer wall surface 16 on the suction side 36 at the forward edge of the slot 26 and then become deeper towards the rearward terminal end in the trailing edge region 22. This variable depth can take on different profiles, including linear and curved. The depth profile of the suction side cooling slots 26 can be different from each other, or can be the same.

Figure 4:
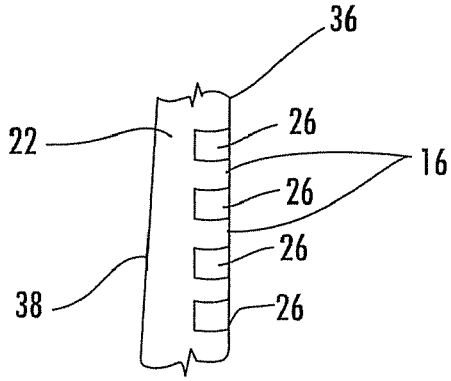
FIG. 4 is a partial front view of the trailing edge looking chord wise taken at line 4-4 in FIG. 3.

FIG. 4 shows the spaced arrangement of the suction side cooling slots 26 along the span wise extend of the trailing edge 22. The suction side cooling slots 26 are spaced as a series, so the opening into the trailing edge region 22 occurs at the span wise location of each slot 26, and the intervening portions of the outer wall 16 of the suction side 36 between the suction side cooling slots 26 continue to the trailing edge 22. The center line as used in this specification is determined by the trailing edge in the intervening portions of the outer wall 16 between the suction side cooling slots 26. The suction side cooling slots 26 provide additional convective surface area for the suction side region of the trailing edge 22 and can serve to slow down the cooling flow in the region to improve cooling effectiveness and reduce the risk of airfoil life-limiting hot spots. The wrapped around suction side cooling slots 26 can also reduce the effective trailing edge thickness, thus reducing aerodynamic blocking loss.

In order to reduce shear mixing between the cooling exit flow and the mainstream hot gas on the pressure side 38, the submerged suction side cooling slots 26 on the suction side 36 are combined with pressure side cooling slots 28 whose rear sides 44 are curved to provide an outlet on the pressure side 38, forward of the trailing edge 22 and forward of the rearward terminal end of the suction side cooling slots 26. This combination can provide cooling to the pressure side trailing edge region on both the pressure side and the suction side while minimizing shear mixing. Because of the curved rear surface 44 of the pressure side cooling slots 28, the cut back distance for these pressure side cooling slots 28 is reduced and the film cooling effectiveness is improved for the cooling of the pressure side region of the trailing edge 22.

According to another aspect of the invention, the front edge 48 of the suction side cooling slots is aligned chord wise or rearward of the front pressure side lip 32 of the pressure side cooling slot 28. The bleed hole 42 is rearward or downstream of the pressure side lip 32. With this arrangement, hot spots in the suction side region rearward of the pressure side lip 32.

During use, cooling fluids may flow into the cooling system 10 from a cooling fluid supply source. A portion of the cooling fluids may flow into the leading edge supply channel 66, through the supply orifices 68 and into the leading edge cooling channel 64. The cooling fluids may then flow from the leading edge supply channel 66 through film cooling holes 70 forming a showerhead in the leading edge 33. The remaining portion of cooling fluids may flow from the cooling fluid supply source into the serpentine cooling channel 54. The cooling fluids may flow back and forth span wise between the root 30 to the tip section 34 in the serpentine cooling channel 54. A portion of the cooling fluids in the serpentine cooling channel 54 may be exhausted through the film cooling holes 70. The remaining portion of the cooling fluids may be passed through the one or more exhaust orifices 58 into the central trailing edge cooling channel 18. The cooling fluids may then flow past the impingement holes 50. The cooling fluids may then be exhausted through the pressure side cooling slots 28 and the suction side cooling slots 26 to cool the trailing edge region 22.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated, hollow airfoil formed by an outer wall extending chord wise from a forward leading edge to a rearward trailing edge, a tip section at a first span wise end, a root coupled to the airfoil at an end generally opposite the first end span wise for supporting the airfoil and for coupling the airfoil to a disc, and a cooling system formed from at least one cavity in the elongated, hollow airfoil positioned in internal aspects of the generally elongated, hollow airfoil; said outer wall having a concave pressure side and a convex suction side separated rearwardly by the trailing edge, said trailing edge having a central camber line with the pressure side on one side of the camber line and the suction side on the other;

at least two submerged suction side cooling slots spaced span wise and each extending chord wise to provide an opening beginning at a front edge on the suction side and extending to a terminal location at the trailing edge;

at least one trailing edge cooling channel positioned within the generally elongated, hollow airfoil and extending toward the trailing edge, but terminating in a pressure side cooling slot having a curving rearward side that curves to a pressure side outlet forward of the trailing edge, said pressure side outlet having a pressure side lip at its forward junction with the pressure side, said front edges of the suction side cooling openings being no further forward chord-wise than the pressure side lip; and at least one boundary layer bleed hole fluidly connecting the pressure side cooling slot to at least one of the suction side cooling slots, said at least one boundary layer bleed hole being no further forward chord-wise than the pressure side lip.

2. The turbine blade of claim 1, wherein the terminal location of the suction side cooling slot opening is on the pressure side of the central camber line of the trailing edge.

3. The turbine blade of claim 1, wherein the terminal location of the suction side cooling slot opening is on the central camber line.

4. The turbine blade of claim 1, wherein each suction side cooling slots have a variable depth into the outer wall, becoming deeper as it extends towards the trailing edge.

5. The turbine blade of claim 4, wherein the variable depth of each suction side cooling slot transitions from the suction side surface to a maximum depth at its opening at the trailing edge.

6. The turbine blade of claim 4, wherein the variable depth of each suction side cooling slot curves towards the trailing edge.

7. The turbine blade of claim 4, wherein one of the suction side cooling slots has a depth that varies differently from the depth of the other suction side cooling slot.

8. The turbine blade of claim 1, wherein the boundary layer bleed hole extends from the curved rearward side of the pressure side cooling slot to at least one of the suction side cooling slots.

9. The turbine blade of claim 8, wherein the boundary layer bleed hole is oriented relative to the convex suction side so that cooling flow in the suction side cooling slot is concurrent with the mainstream flow along the suction side, whereby shear mixing between the mainstream flow and the cooling flow is reduced.

10. The turbine blade of claim 1, wherein the profile shape of each suction side cooling slot is oriented relative to the convex suction side so that cooling flow in the suction side cooling slot is concurrent with the mainstream flow along the suction side, whereby shear mixing between the mainstream flow and the cooling flow is reduced.

11. The turbine blade of claim 1, wherein a pressure side cooling slot and fluidly connecting boundary layer bleed hole connects to a separate one of the suction side cooling slots.

12. The turbine blade of claim 1, wherein the pressure side cooling slot is shaped to include a metering section sized to substantially match cooling flow conditions to hot gas flow conditions prior to discharge from the pressure side cooling slot.

13. The turbine blade of claim 12, wherein the pressure side cooling slot is shaped to include a diffuser section wherein the cross-sectional area of the pressure side cooling slot increases towards the pressure side outlet.

14. The turbine blade of claim 1, wherein the trailing edge cooling channel provides impingement holes and cavities for double impingement cooling.

* * * * *